US010955789B2

(12) United States Patent
Yoshimoto

(10) Patent No.: US 10,955,789 B2
(45) Date of Patent: Mar. 23, 2021

(54) CLEANING DEVICE HAVING FUNCTION THAT RESTRICTS MOVEMENT RANGE OF CLEANING BLADE AND IMAGE FORMING APPARATUS HAVING CLEANING DEVICE

(71) Applicant: SHARP KABUSHIKI KAISHA, Sakai (JP)

(72) Inventor: Yuhsuke Yoshimoto, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/689,953

(22) Filed: Nov. 20, 2019

(65) Prior Publication Data

US 2020/0159160 A1 May 21, 2020

(30) Foreign Application Priority Data

Nov. 21, 2018 (JP) ..... JP2018-218369

(51) Int. Cl.
*G03G 21/00* (2006.01)

(52) U.S. Cl.
CPC ..... *G03G 21/0011* (2013.01)

(58) Field of Classification Search
CPC ..... G03G 21/0011; G03G 21/0029
USPC ..... 399/350, 351
See application file for complete search history.

(56) References Cited

U.S. PATENT DOCUMENTS 4,768,062 A * 8/1988 Tanzawa et al. .. G03G 21/0029 399/351
7,848,694 B2 * 12/2010 Nakatake et al. . G03G 21/0017 399/350
8,131,199 B2 * 3/2012 Watanabe et al. ..... G03G 21/0029 399/351

FOREIGN PATENT DOCUMENTS

JP 2014-211518 A 11/2014

* cited by examiner

*Primary Examiner* — William J Royer
(74) *Attorney, Agent, or Firm* — ScienBiziP, P.C.

(57) ABSTRACT

Provided is an image forming apparatus configured to form a toner image on a photoreceptor drum, transfer the toner image to a recording medium, and output the recording medium, and the image forming apparatus includes a cleaning device including a cleaning blade that abuts against the photoreceptor drum and removes residual developer, a cleaning blade supporter that rotatably supports the cleaning blade, a cleaning blade movement restrictor that restricts a movement range of the cleaning blade, and a spring member that urges an end of the cleaning blade to abut against the photoreceptor drum.

8 Claims, 12 Drawing Sheets

CLEANING DEVICE HAVING FUNCTION THAT RESTRICTS MOVEMENT RANGE OF CLEANING BLADE AND IMAGE FORMING APPARATUS HAVING CLEANING DEVICE

This Nonprovisional application claims priority under 35 U.S.C. § 119(a)on Patent Application No. 2018-218369 filed in Japan on 21 Nov. 2018, the entire contents of which are hereby incorporated by reference.

BACKGROUND OF THE INVENTION

Field of the Invention

The present invention relates to a cleaning device, particularly relates to a cleaning device that removes residual developer on a photoreceptor drum of an image forming apparatus, and an image forming apparatus.

Description of the Background Art

Electrophotographic image forming apparatus typically includes a cleaning device for removing developer remaining on a photoreceptor drum. Such cleaning device typically performs scraping by using a cleaning blade.

There are two known types of configurations of the cleaning device, i.e., a cleaning device based on a so-called constant load method in which a spring is used to apply a constant load to a cleaning blade so that a blade edge abuts against the photoreceptor drum and applies a constant linear pressure, and a cleaning device based on a so-called constant displacement method in which a cleaning blade is displaced by a predetermined amount to cause the blade edge to abut against a photoreceptor drum (see Japanese Unexamined Patent Application Publication No. 2014-211518).

In the known cleaning devices in which the constant load method is used, a constant linear pressure is constantly applied to the blade edge, and thus the cleaning performance can be stabilized. However, as the displacement of the cleaning blade is increased over time or due to deterioration of blade rubber or other reasons, an abutment angle (cleaning angle) with respect to the photoreceptor drum may become smaller, and thus planar contact, i.e., surface contact, between the blade edge and the drum may occur. Such surface contact may result in escaping of developer, leading to cleaning failure.

Further, in the known cleaning devices in which the constant displacement method is used, the linear pressure may be decreased due to, for example, the displacement of the blade rubber over time, and thus escaping of developer may occur, and as a result, cleaning failure may occur.

The present invention has been made to solve the above-described known problems, and an object of the present invention is to provide a cleaning device, etc. capable of suppressing failure in cleaning residual developer on a photoreceptor drum.

SUMMARY OF THE INVENTION

The present invention is a cleaning device including a cleaning blade that abuts against a photoreceptor drum and removes residual developer, a cleaning blade supporter that rotatably supports the cleaning blade, a cleaning blade movement restrictor that restricts a movement range of the cleaning blade, and an urging force applier for the cleaning blade that urges an end of the cleaning blade to abut against the photoreceptor drum.

Furthermore, the present invention is an image forming apparatus configured to form a developer image on a photoreceptor drum, transfers the developer image to a recording medium, and outputs the recording medium, and the image forming apparatus includes a cleaning device including a cleaning blade that abuts against a photoreceptor drum and removes residual developer, a cleaning blade supporter that rotatably supports the cleaning blade, a cleaning blade movement restrictor that restricts a movement range of the cleaning blade, and an urging force applier for the cleaning blade that urges an end of the cleaning blade to abut against the photoreceptor drum.

Since the cleaning device according to the present invention includes the cleaning blade that abuts against the photoreceptor drum and removes the residual developer, the cleaning blade supporter that rotatably supports the cleaning blade, the cleaning blade movement restrictor that restricts a movement range of the cleaning blade, and the urging force applier for the cleaning blade that urges the end of the cleaning blade to abut against the photoreceptor drum, it is possible to achieve a stable abutment state of the cleaning blade against the photoreceptor drum, and thus to provide a cleaning device that can suppress failure in cleaning the residual developer on the photoreceptor drum.

In addition, the image forming apparatus according to the present invention is an image forming apparatus configured to form a developer image on a photoreceptor drum, transfers the developer image to a recording medium, and outputs the recording medium, and the image forming apparatus includes the cleaning device including the cleaning blade that abuts against the photoreceptor drum and removes the residual developer, the cleaning blade supporter that rotatably supports the cleaning blade, the cleaning blade movement restrictor that restricts a movement range of the cleaning blade, and the urging force applier for the cleaning blade that urges the end of the cleaning blade to abut against the photoreceptor drum, and thus it is possible to achieve a stable abutment state of the cleaning blade against the photoreceptor drum. Therefore failure in cleaning the residual developer on the photoreceptor drum can be suppressed, and as a result, it is possible to provide an image forming apparatus that can output good quality of images.

DESCRIPTION OF THE PREFERRED EMBODIMENTS

First Embodiment

A first embodiment according to the present invention will be described below with reference to the accompanying drawings.

Figure 1:
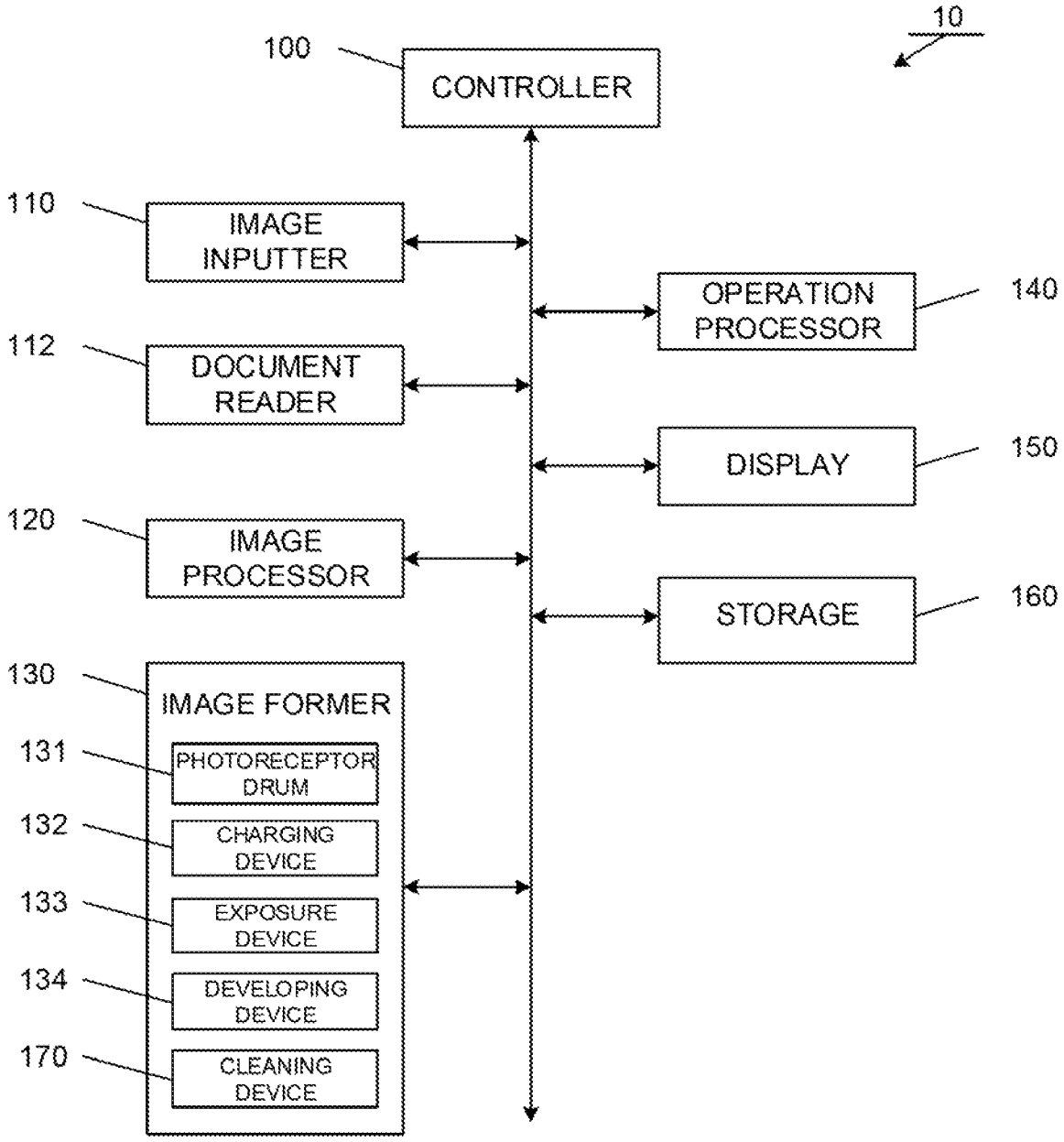
FIG. 1 is a block diagram illustrating a configuration of an image forming apparatus according to a first embodiment.
Figure 2:
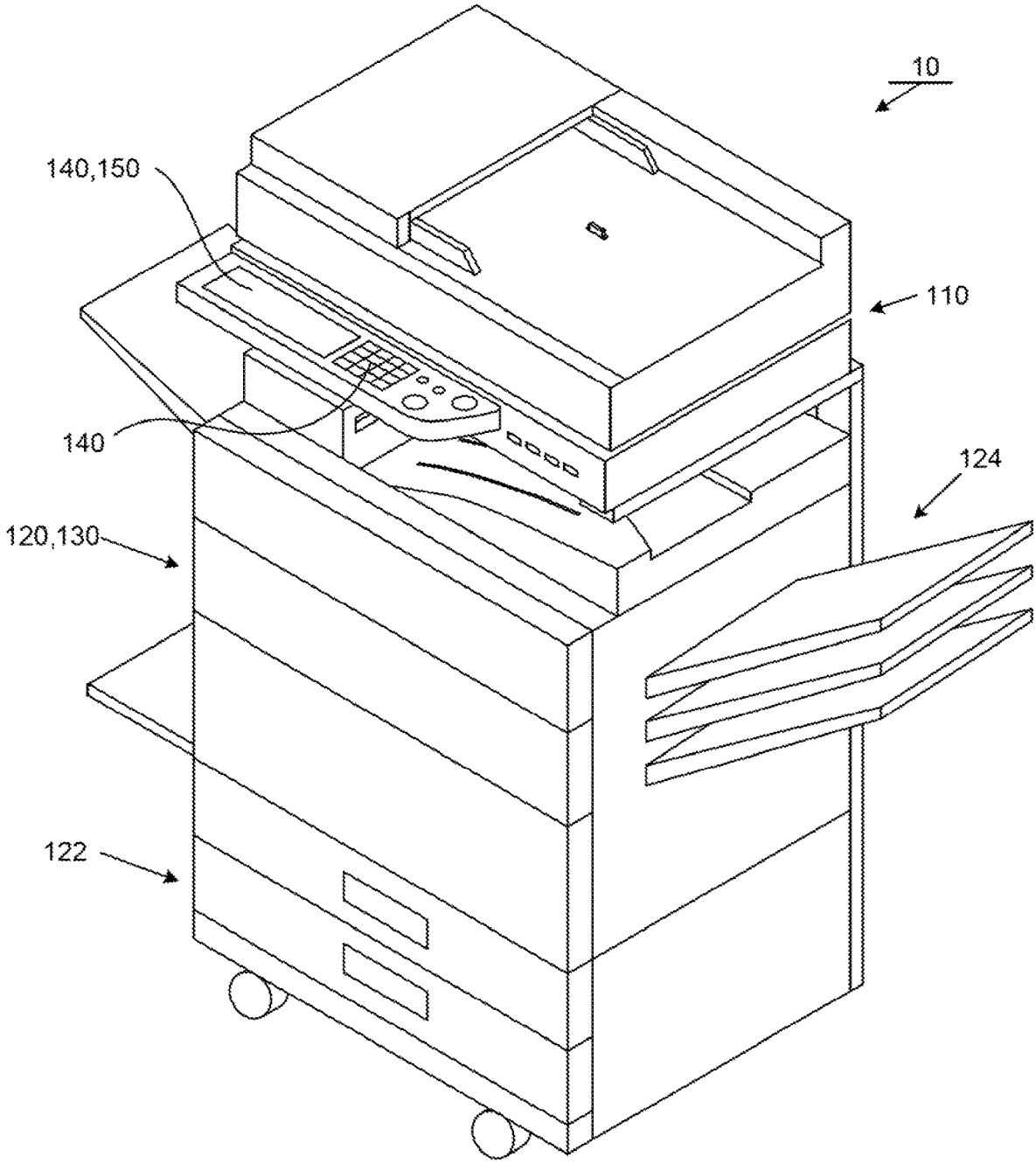
FIG. 2 is a schematic explanatory diagram illustrating the configuration of the image forming apparatus.

FIG. 1 is a block diagram illustrating a configuration of an image forming apparatus according to a first embodiment of the present invention, which is an example of embodiments of the present invention, and FIG. 2 is a schematic explanatory diagram illustrating the configuration of the image forming apparatus.

The first embodiment is characterized in that, as illustrated in FIG. 1, in an image forming apparatus 110 configured to form a developer image on a photoreceptor drum 131, transfer the developer image to a recording medium, and output the recording medium, the image forming apparatus 10 includes a characteristic cleaning device 170 that removes residual developer on the photoreceptor drum 131 after the transfer, and thereby failure in cleaning the residual toner (residual developer) on the photoreceptor drum 131 is suppressed to achieve good quality of images.

Configuration of Image Forming Apparatus

First, a basic configuration of the image forming apparatus 10 according to the first embodiment will be described.

As illustrated in FIG. 1, the image forming apparatus 10 is an information processing apparatus that outputs images using electrophotography and includes, in the upper part of the main body of the image forming apparatus 10, a document reader 112 that reads an image of a document.

As illustrated in FIG. 1, the image forming apparatus 10 mainly includes a controller 100, an image inputter 110, an image processor 120, an image former 130, an operation processor 140, a display 150, and a storage 160.

The controller 100 is a functional unit for controlling the entire image forming apparatus 10.

The controller 100 performs various functions by reading and executing various programs, and includes, for example, one or more arithmetic devices (for example, a central processing unit (CPU)).

The image inputter 110 is a functional unit for reading image data input to the image forming apparatus 10. The image inputter 110 is coupled to the document reader 112 that is a functional unit for reading an image of a document, and inputs image data output from the document reader 112.

The image inputter 110 may input image data from a storage medium such as a universal serial bus (USB) flash drive or an SD card. The image inputter 110 may include a communicator that is connected with another terminal device and input image data from the other terminal device.

The image processor 120 is a functional unit for forming, on a recording medium (for example, a recording sheet), output data based on image data. For example, as illustrated in FIG. 2, a recording sheet is fed from a paper feed tray 122, and, in the image processor 120, an image is formed on a surface of the recording sheet, and then the sheet is ejected to a paper discharge tray 124. The image processor 120 includes, for example, a laser printer using electrophotographic.

The image former 130 is a functional unit that performs various image processing for image data. In addition, the image former 130 forms an output image based on the image data that has been subjected to image processing.

Specifically, as illustrated in FIG. 1, a charging device 132 applies a charging bias to the surface of the photoreceptor drum 131 to charge the surface of the photoreceptor drum 131. Then, an exposure device 133 forms an electrostatic latent image on the charged surface of the photoreceptor drum 131. Then, a developing device 134 forms a toner image on the surface of the photoreceptor drum 131. The toner image formed on the surface of the photoreceptor drum 131 is transferred to a recording sheet, which is output as a printed matter.

The image former 130 includes the cleaning device 170. Residual toner on the photoreceptor drum 131 after the transfer is removed by the cleaning device 170.

The operation processor 140 is a functional unit for receiving operational instructions from a user, and includes various key switches, a device that detects touch input, etc. The user can use the operation processor 140 to input a function to he used and an output condition. The display 150 is a functional unit for displaying various types of information to the user, and includes, for example, a liquid crystal display (LCD).

The image forming apparatus 10 may include a touch panel in which the operation processor 140 and the display 150 are integrally formed, as illustrated in FIG. 2. In this case, a method used to detect input to the touch panel may he a common detection method such as a resistive film method, touch screen technology utilizing infrared or electromagnetic induction, or an electrostatic capacitive method.

The storage 160 is a functional unit that stores various programs and various data necessary for the operation of the image forming apparatus 10. The storage 160 includes, for example, a solid state drive (SSD) that is a semiconductor memory, and a hard disk drive (HDD).

Configuration of Cleaning Device

Next, the characteristic cleaning device 170 according to the first embodiment will be described.

Figure 3:
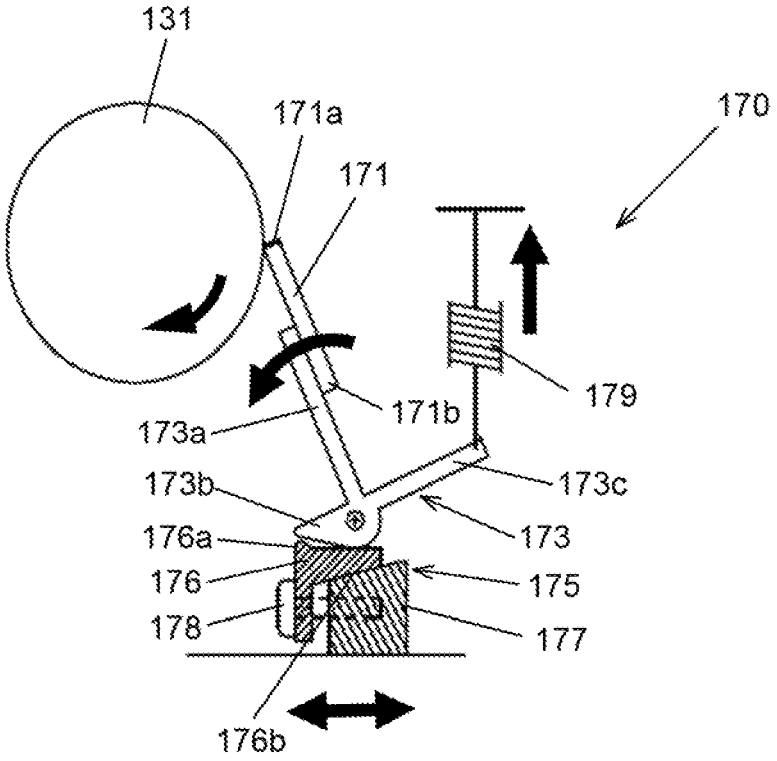
FIG. 3 is a schematic explanatory diagram illustrating a configuration of a cleaning device included in the image forming apparatus.
Figure 4:
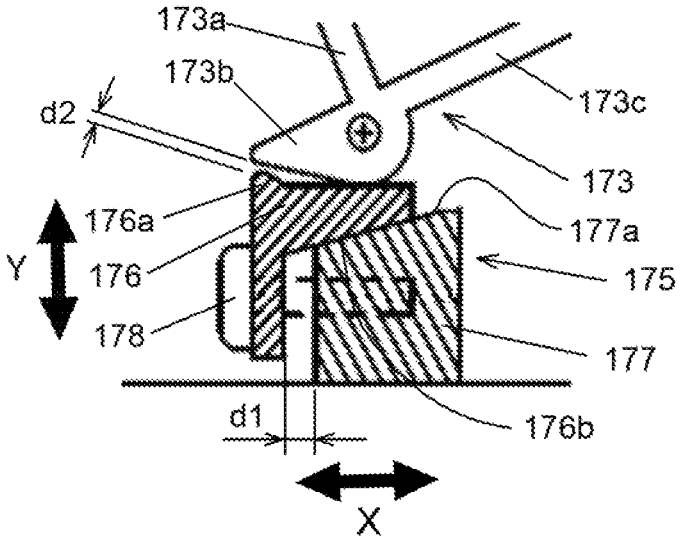
FIG. 4 is an explanatory view illustrating a configuration of a cleaning blade movement restrictor included in the cleaning device.

FIG. 3 is a schematic explanatory diagram illustrating a configuration of a cleaning device included in the image forming apparatus according to the first embodiment, and FIG. 4 is an explanatory view illustrating a configuration of a cleaning blade movement restrictor included in the cleaning device.

As illustrated in FIG. 3, the cleaning device 170 according to the first embodiment mainly includes a cleaning blade 171, a cleaning blade supporter 173, a cleaning blade movement restrictor 175, a member (urging force applier for the cleaning blade) 179.

The cleaning blade 171 is provided along the longitudinal direction of the photoreceptor drum 131. One end 171*a* of the cleaning blade 171 abuts against the surface of the photoreceptor drum 131 to remove residual toner (developer) at least in a region where a toner image is formed.

The cleaning blade supporter 173 holds a side of the other end 171*b* of the cleaning blade 171 and rotatably supports the cleaning blade 171 such that the cleaning blade 171 abuts against/separates from the photoreceptor drum 131.

The cleaning blade supporter 173 includes a holder 173*a* that holds the cleaning blade 171, an abutment part 173*b* that abuts against the cleaning blade movement restrictor 175, and an attachment part 173*c* to which one end of the spring member 179 is attached.

The cleaning blade movement rest or 175 abuts against the abutment part 173*b* of the cleaning blade supporter 173 to restrict the movement range of the cleaning blade supporter 173, and as a result, the movement range of the cleaning blade 171 is restricted.

As illustrated in FIG. 4, the cleaning blade movement restrictor 175 includes a cleaning blade position adjuster 176 and an attachment part 177. The cleaning blade position adjuster 176 adjusts a position where the movement range of the cleaning blade 171 is restricted by the abutment of the abutment part 173*b* of the cleaning blade supporter 173 against the cleaning blade position adjuster 176. The attachment part 177 allows the attachment position of the cleaning blade position adjuster 176 to be changed.

The cleaning blade position adjuster 176 is attached to the attachment part 177 with an attachment screw 178.

The cleaning blade position adjuster 176 includes an abutment part 176*a* and an inclined surface 176*b*.

The abutment part 176*a* protrudes toward where the abutment part 173*b* of the cleaning blade supporter 173 is disposed. The abutment part 173*b* of the cleaning blade supporter 173 abuts against the abutment part 176*a* to restrict the movement range of the cleaning blade supporter 173.

The inclined surface 176*b* is an attachment surface that is attached to the attachment part 177. The inclined surface 176*b* is attached to an inclined surface 177*a* formed in the upper part of the attachment part 177 and displaces the position of the abutment part 176*a* depending on the attachment position.

Specifically, as illustrated in FIG. 4, by displacing the cleaning blade position adjuster 176, along the inclined surface 177*a* of the attachment part 177, in the direction represented by arrow X (left-right direction in the figure), it is possible to displace the cleaning blade position adjuster 176 in the direction represented by arrow Y (up-down direction in the figure). In other words, by adjusting a gap d1 between the cleaning blade position adjuster 176 and the attachment part 177, it is possible to adjust a gap d2 between the abutment part 173*b* of the cleaning blade supporter 173 and the abutment part 176*a* of the cleaning blade position adjuster 176.

The spring member 179 is a tension spring, and as illustrated in FIG. 3, one end of the spring member 179 is attached to the attachment part 173*c* of the cleaning blade supporter 173. The spring member 179 urges the end 171*a* of the cleaning blade 171 to abut against the photoreceptor drum 131.

Abutment State between Photoreceptor Drum and Cleaning Blade

Here, an abutment state between the cleaning blade 171 and the photoreceptor drum 131 in the cleaning device 170 according to the first embodiment will be described.

Figure 5:
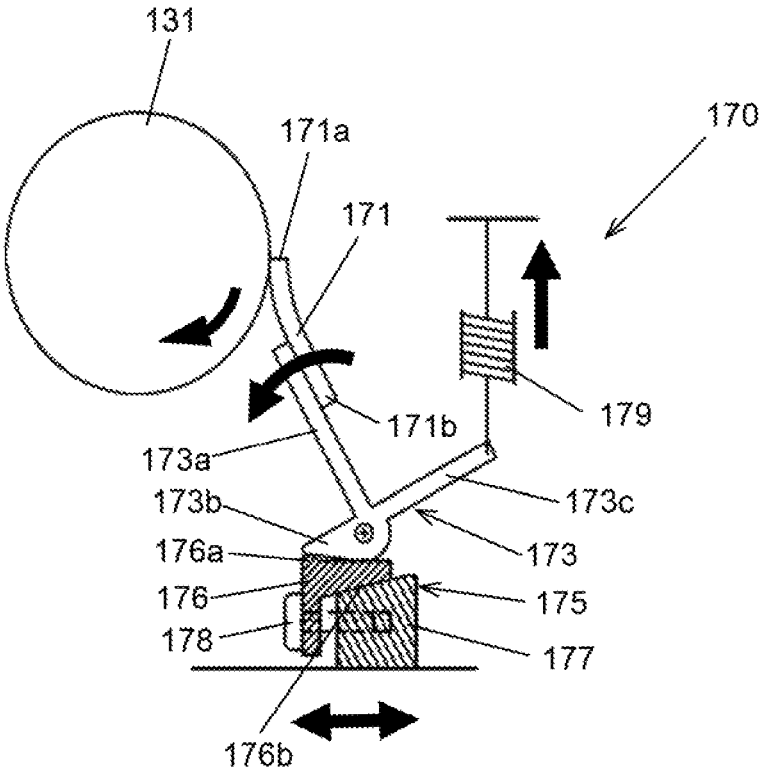
FIG. 5 is an explanatory diagram illustrating an abutment state between a photoreceptor drum and a cleaning blade in a second abutment state in the cleaning device.
Figure 6:
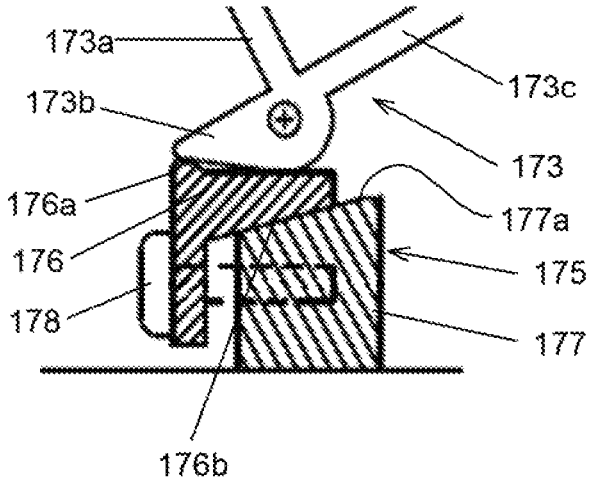
FIG. 6 is an explanatory diagram illustrating an abutment state between a cleaning blade supporter and a cleaning blade position adjuster in the second abutment state.

FIG. 5 is an explanatory diagram that illustrates an abutment state between the photoreceptor drum and the cleaning blade in a second abutment state in the cleaning device according to the first embodiment, and FIG. 6 is an explanatory diagram that illustrates an abutment state between the cleaning blade supporter and the cleaning blade position adjuster in the second abutment state.

The abutment state between the photoreceptor drum 131 and the cleaning blade 171 when the residual toner on the photoreceptor drum 131 is removed by the cleaning device 170 includes a first abutment state based on the constant load method and the second abutment state based on the constant displacement method.

In the first abutment state, as illustrated in FIG. 3, when the photoreceptor drum 131 and the end 171*a* of the cleaning blade 171 abut on each other, the urging force applied by the spring member 179 causes the end 171*a* of the cleaning blade 171 and the photoreceptor drum 131 to abut on each other, while the abutment part 173*b* of the cleaning blade supporter 173 and the abutment part 176*a* of the cleaning blade position adjuster 176 do not abut on each other, as illustrated in FIG. 4.

Initially, the displacement of the cleaning blade 171 is small, and the first abutment state based on the "constant load method" in which the linear pressure applied, by the abutment part of the cleaning blade 171, to the photoreceptor drum 131 can be kept constant is established. As a result, it is ensured that the cleaning blade 171 performs cleaning with a required linear abutment pressure.

In the second abutment state, as illustrated in FIG. 5, when the photoreceptor drum 131 and the end 171*a* of the cleaning blade 171 abut on each other, the urging force applied by the spring member 179 causes the end 171*a* of the cleaning blade 171 to abut against the photoreceptor drum 131, while the abutment part 173*b* of the cleaning blade supporter 173 and the abutment part 176*a* of the cleaning blade position adjuster 176 abut on each other, as illustrated in FIG. 6.

As the displacement of the cleaning blade 171 increases over time or due to a reason relating to the life of the cleaning blade 171 or other reasons, the abutment angle of the cleaning blade 171 with respect to the photoreceptor drum 131 increases. In this situation, the second abutment state based on the "constant displacement method" in which displacement of the cleaning blade 171 exceeding a predetermined amount is prevented is used to prevent surface contact of the cleaning blade 171 which may result in escaping of removed residual toner.

In the first abutment state in which a constant load is applied by the spring member 179, deformation or displacement of the cleaning blade 171 causes a change of the abutment angle between the photoreceptor drum 131 and the end 171*a* of the cleaning blade 171, but, in the second abutment state, a change in the abutment angle between the photoreceptor drum 131 and the end 171*a* of the cleaning blade 171 does not exceed a predetermined amount, because of abutment of the abutment part 173*b* of the cleaning blade supporter 173 against the abutment part 176*a* of the cleaning blade position adjuster 176.

As a result, it is possible to prevent a change in the abutment angle between the photoreceptor drum 131 and the end 171*a* of the cleaning blade 171 from exceeding a predetermined amount, and thus to prevent surface contact between the cleaning blade 171 and the photoreceptor drum 131.

EXAMPLES

Here, the cleaning device 170 according to the first embodiment will be described with reference to a specific example.

Figure 7:
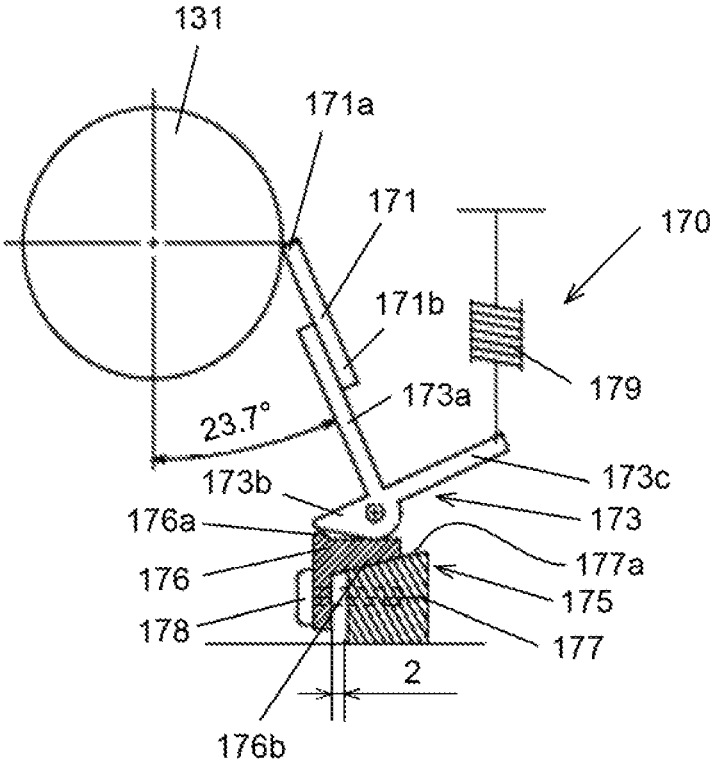
FIG. 7 is an explanatory diagram illustrating an example of a first abutment state between the photoreceptor drum and the cleaning blade in the cleaning device.
Figure 8:
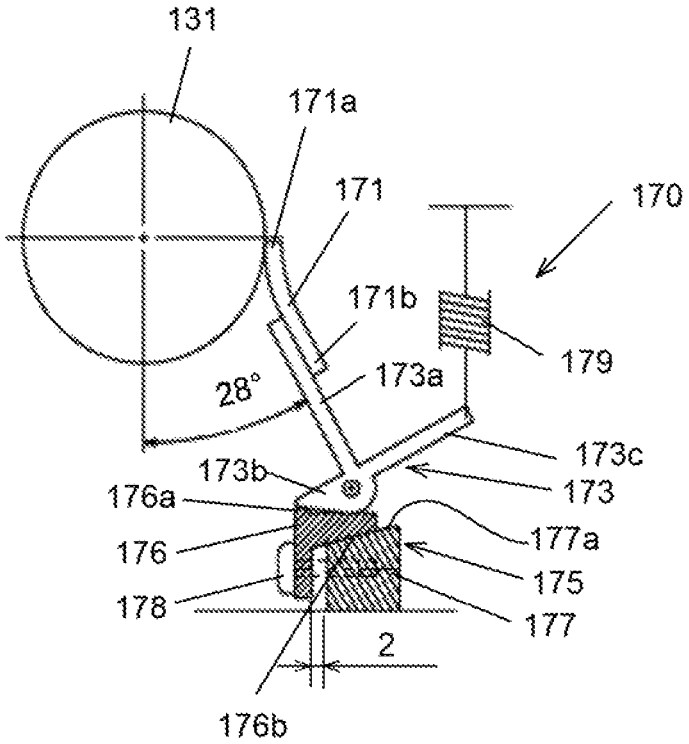
FIG. 8 is an explanatory diagram illustrating an example of the second abutment state between the photoreceptor drum and the cleaning blade in the cleaning device.

FIG. 7 is an explanatory diagram illustrating an example of the first abutment state between the photoreceptor drum and the cleaning blade in the cleaning device according to the first embodiment, and FIG. 8 is an explanatory diagram illustrating an example of the second abutment state between the photoreceptor drum and the cleaning blade in the cleaning device.

In the example, in an initial period of usage of the cleaning blade 171, as illustrated in FIG. 7, the abutment state between the photoreceptor drum 131 and the cleaning blade 171 is the first abutment state in which the abutment state between the photoreceptor drum 131 and the cleaning blade 171 is established based on the constant load method.

When the cleaning blade 171 is nearing the end of its life and has been significantly displaced over time, as illustrated in FIG. 8, the abutment state between the photoreceptor drum 131 and the cleaning blade 171 is the second abutment state based on a fixed position method.

Specifically, the first abutment state is a state in which the cleaning blade 171 abuts against the photoreceptor drum 131, when an inclination angle, relative to the vertical direction, of the holder 173*a* of the cleaning blade supporter 173 is 23.7 degrees.

The end 171*a* of the cleaning blade 171 is urged, by the spring member 179, against the surface of the photoreceptor drum 131.

The cleaning blade movement restrictor 175 is attached so that the gap between the cleaning blade position adjuster 176 and the attachment part 177 is 2 (mm). The abutment part 173*b* of the cleaning blade supporter 173 and the abutment part 176*a* of the cleaning blade position adjuster 176 do not abut on each other.

On the other hand, the second abutment state is a state in which the abutment part 173*b* of the cleaning blade supporter 173 abuts against the abutment part 176*a* of the cleaning blade position adjuster 176, when, after the cleaning blade 171 has been displaced over time, the inclination angle, relative to the vertical direction, of the holder 173*a* of the cleaning blade supporter 173 is 28 degrees.

When the inclination angle of the holder 173*a* of the cleaning blade supporter 173 is 28 degrees or less, the cleaning blade 171 abuts a gins the photoreceptor drum 131 so that surface contact does not occur.

In the example, when the displacement of the cleaning blade 171 over time is less than or equal to a predetermined amount, the photoreceptor drum 131 and the cleaning blade 171 are in the first abutment state and the cleaning process by the cleaning blade 171 can be stably performed under the condition of the constant load.

When the inclination angle of the holder 173*a* of the cleaning blade supporter 173 reaches 28 degrees, and thus, the displacement of the cleaning blade 171 reaches a predetermined amount, the abutment part 173*b* of the cleaning blade supporter 173 abuts against the abutment part 176*a* of the cleaning blade position adjuster 176 and the second abutment state based on the constant displacement method is established. In the second abutment state, displacement of the cleaning blade 171 exceeding the predetermined amount can be prevented, and escaping of removed residual toner due to surface contact of the cleaning blade 171 can be suppressed.

According to the first embodiment having the above-described configuration, the image forming apparatus 10 includes the cleaning device 170 that removes the residual developer on the photoreceptor drum 131 after the transfer, and the cleaning device 170 includes the cleaning blade 171, the cleaning blade supporter 173, the cleaning blade movement restrictor 175, and the spring member 179, and thus it is possible to achieve a stable abutment state between the photoreceptor drum 131 and the cleaning blade 171, and suppress failure in cleaning the residual toner on the photoreceptor drum 131.

Furthermore, in the first embodiment, the first abutment state based on the constant load method is formed by using the cleaning blade supporter 173 and the spring member 179, the second abutment state based on the constant displacement method is formed by using the cleaning blade supporter 173 and the cleaning blade movement restrictor 175, and the abutment state between the photoreceptor drum 131 and the cleaning blade 171 is switched to the second abutment state after a period of the first abutment state elapses. Thus, the process for cleaning the residual toner can be stably performed over a long period of time.

Further, in the first embodiment, the protruding abutment part 176*a* is provided on the cleaning blade position adjuster 176, and thus stable abutment state of the abutment part 173*b* of the cleaning blade supporter 173 against the cleaning blade position adjuster 176 can be established.

Further, in the first embodiment, the cleaning blade movement restrictor 175 includes the cleaning blade position adjuster 176 and the attachment part 177, and displaceable attachment is achieved by using the inclined surfaces 176*b* and 177*a* formed on the cleaning blade position adjuster 176 and the attachment part 177, respectively, and thus the abutment position with respect to the cleaning blade supporter 173 can easily be adjusted.

Second Embodiment

Next, a second embodiment will be described.

The second embodiment is characterized in that switching from the first abutment state to the second abutment state occurs at a timing different from the example of the cleaning device 170 according to the first embodiment.

Figure 9:
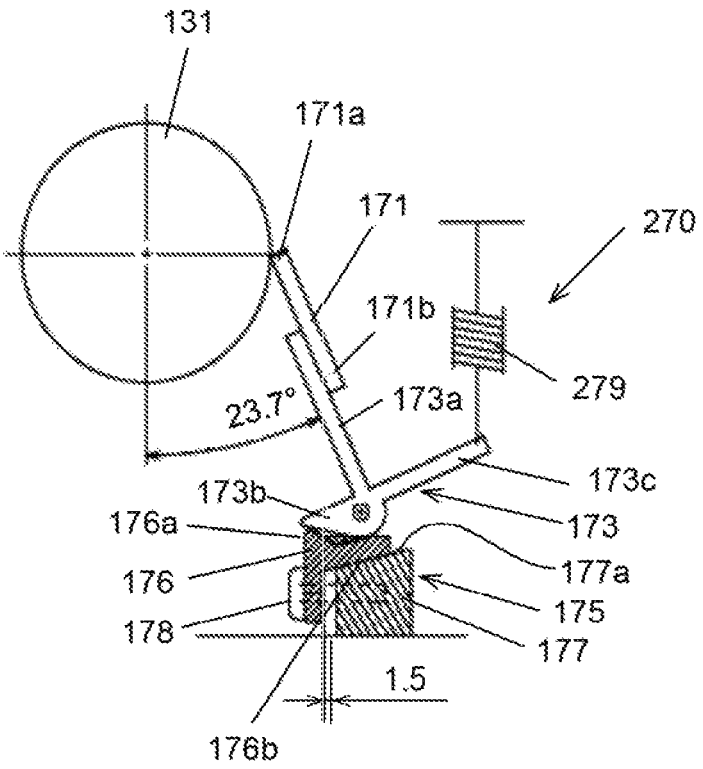
FIG. 9 is an explanatory diagram illustrating the first abutment state between the photoreceptor drum and the cleaning blade in a cleaning device according to a second embodiment.
Figure 10:
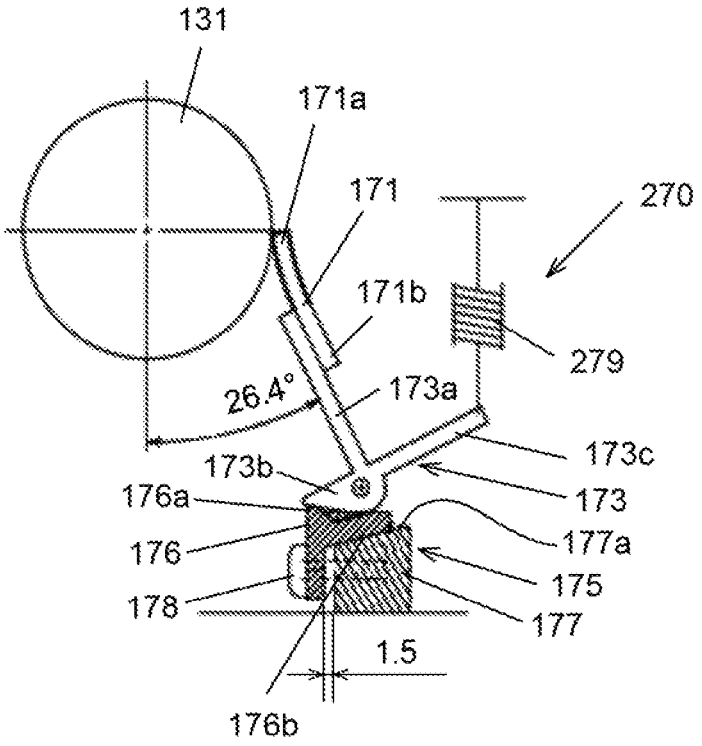
FIG. 10 is an explanatory diagram illustrating the second abutment state between the photoreceptor drum and the cleaning blade in the cleaning device.

FIG. 9 is an explanatory diagram illustrating the first abutment state between the photoreceptor drum and the cleaning blade in a cleaning device according to the second embodiment, and FIG. 10 is an explanatory diagram illustrating the second abutment state between the photoreceptor drum and the cleaning blade in the cleaning device.

Note that in the second embodiment, for convenience of explanation, components having the same functions as those m the first embodiment are designated by using the same reference numerals, and description for those components will not be repeated.

In the cleaning device of the image forming apparatus, when a linear abutment pressure of the cleaning blade is set to be high, the displacement of the cleaning blade may increase faster in an earlier stage of life of the cleaning blade. Therefore, when a linear abutment pressure of the cleaning blade is set to be high, the abutment state between the photoreceptor drum and the cleaning blade should be appropriately set considering the displacement of the cleaning blade.

In a cleaning device 270 according to the second embodiment, during an initial period of usage of the cleaning blade 171, as illustrated in FIG. 9, the abutment state between the photoreceptor drum 131 and the cleaning blade 171 is the first abutment state in which the abutment state between the photoreceptor drum 131 and the cleaning blade 171 is established based on the constant load method.

When a linear abutment pressure of the cleaning blade 171 is set to be high, the cleaning blade 171 is displaced significantly in an earlier stage of life of the cleaning blade 171, and thus the abutment state between the photoreceptor drum 131 and the cleaning blade 171 is switched early to the second abutment state based on the fixed position method, as illustrated in FIG. 10, to prevent significant change in linear pressure due to the increased displacement of the cleaning blade 171.

Specifically, the first abutment state is a state in which the cleaning blade 171 abuts against the photoreceptor drum 131, when an inclination angle, relative to the vertical direction, of the holder 173*a* of the cleaning blade supporter 173 is 23.7 degrees.

The end 171*a* of the cleaning blade 171 is urged, by a spring member 279, against the surface of the photoreceptor drum 131. The spring member 279 applies a stronger force compared to the spring member 179 in the first embodiment.

The cleaning blade movement restrictor 175 is attached so that the gap between the cleaning blade position adjuster 176 and the attachment part 177 is 1.5 (mm). The abutment part 173*b* of the cleaning blade supporter 173 and the abutment part 176*a* of the cleaning blade position adjuster 176 do not abut on each other.

On the other hand, the second abutment state is a state in which the abutment part 173*b* of the cleaning blade supporter 173 and the abutment part 176*a* of the cleaning blade position adjuster 176 abut on each other, when, after the cleaning blade 171 has been displaced over time, the inclination angle, relative to the vertical direction, of the holder 173*a* of the cleaning blade supporter 173 is 26.4 degrees.

When the inclination angle of the holder 173*a* of the cleaning blade supporter 173 is 26.4 degrees or less, the cleaning blade 171 abuts against the photoreceptor drum 131 so that surface contact does not occur.

According to the second embodiment having the above-described configuration, when a linear abutment pressure of the cleaning blade 171 is set to be high in the cleaning device 270, the abutment state between the photoreceptor drum 131 and the cleaning blade 171 is switched from the first abutment state to the second abutment state before the cleaning blade 171 is significantly displaced. Thus, it is possible to prevent significant change in linear pressure due to the increased displacement of the cleaning blade 171, and thus the cleaning process can be performed by using a stable linear abutment pressure of the cleaning blade 171.

Third Embodiment

Next, a third embodiment will be described.

The third embodiment is characterized in that, in the cleaning device in the image forming apparatus 10 according to the first embodiment, the linear abutment pressure of the cleaning blade with respect to the photoreceptor drum is set to be constant.

Figure 11:
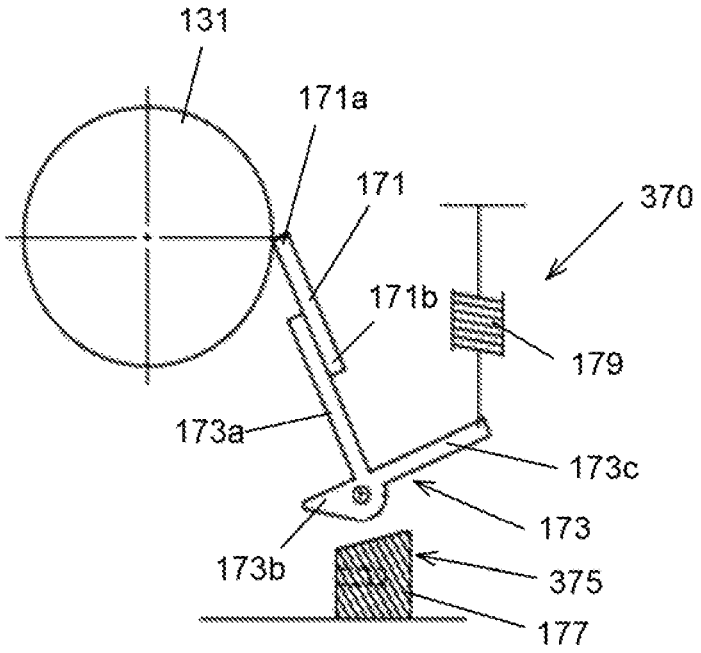
FIG. 11 is an explanatory diagram illustrating the first abutment state between the photoreceptor drum and the cleaning blade in a cleaning device according to a third embodiment.
Figure 12:
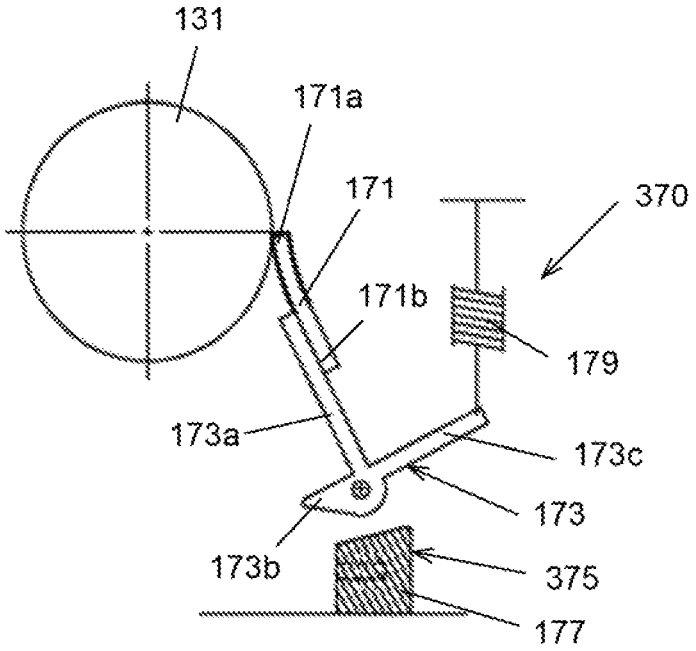
FIG. 12 is an explanatory diagram illustrating a state in which the cleaning blade abutting against the photoreceptor drum is displaced in the cleaning device.

FIG. 11 is an explanatory diagram illustrating the first abutment state between the photoreceptor drum and the cleaning blade in a cleaning device according to the third embodiment, and FIG. 12 is an explanatory view of the cleaning device when the cleaning blade abutting against the photoreceptor drum is displaced.

Note that in the third embodiment, for convenience of explanation, components having the same functions as those in the first embodiment are designated by using the same reference numerals, and description for those components will not be repeated.

As illustrated in FIG. 11, in a cleaning device 370 according to the third embodiment, the abutment state between the photoreceptor drum 131 and the cleaning blade 171 is always the first abutment state based on the constant load method.

The urging force applied by the spring member 179 causes the cleaning blade 171 to abut against the photoreceptor drum 131 and the cleaning blade 171 applies a constant linear abutment pressure to the photoreceptor drum 131.

A cleaning blade movement restrictor 375 includes only the attachment part 177, and does not include the cleaning blade position adjuster 176.

The cleaning blade supporter 173 turnably supports the cleaning blade 171, in a state the cleaning blade 171 abuts against the photoreceptor drum 131, and the turning movement in a range in which the cleaning blade 171 can be displaced is not restricted. In other words, the abutment part 173*b* of the cleaning blade supporter 173 is provided to not abut against the cleaning blade movement restrictor 375.

According to the third embodiment having the above-described configuration, in the cleaning device 370, the urging force applied by the spring member 179 causes the cleaning blade 171 to abut against the photoreceptor drum 131 such that the cleaning blade 171 applies a constant linear abutment pressure, and the cleaning blade supporter 173 supports the cleaning blade 171 such that the turning movement in a range in which the cleaning blade 171 can be displaced is not restricted, and thus the abutment state between the photoreceptor drum 131 and the cleaning blade 171 can be always the first abutment state based on the constant load method. As a result the cleaning process based on the constant load method can be performed until the end of life of the cleaning blade 171.

As described above, the present invention is not limited to the above-described examples and embodiments, and various modifications can be made without departing from the scope of the claims. It is obvious that those skilled in the art can conceive variations or modifications included in the scope of the claims. In other words, the technical scope of the present invention includes embodiments implemented as combinations of technical means modified as appropriate without departing from the spirit of the present invention.

DESCRIPTION OF REFERENCE NUMERALS

10 Image forming apparatus
131 Photoreceptor drum
170, 270, 370 Cleaning device
171 Cleaning blade
173 Cleaning blade supporter
175, 375 Cleaning blade movement restrictor
176 Cleaning blade position adjuster
177 Attachment part
179, 279 Spring member (urging force applies for cleaning blade)

What is claimed is:

1. A cleaning device, comprising:

a cleaning blade that abuts against a photoreceptor drum and removes residual developer;

a cleaning blade supporter that rotatably supports the cleaning blade;

a cleaning blade movement restrictor that restricts a movement range of the cleaning blade; and an urging force applier for the cleaning blade that urges an end of the cleaning blade to abut against the photoreceptor drum wherein the cleaning blade movement restrictor includes a cleaning blade position adjuster that adjusts a position where the movement range of the cleaning blade is restricted by abutment of a part of the cleaning blade supporter against the cleaning blade position adjuster.

2. The cleaning device according to claim 1, wherein an abutment state between the photoreceptor drum and the end of the cleaning blade includes a first abutment state in which when the photoreceptor drum and the end of the cleaning blade abut on each other, an urging force applied by the urging force applier for the cleaning blade causes the end of the cleaning blade and the photoreceptor drum to abut on each other, in a state where the part of the cleaning blade supporter and the cleaning blade movement restrictor do not abut on each other.

3. The cleaning device according to claim 1, wherein an abutment state between the photoreceptor drum and the end of the cleaning blade includes a second abutment state in which when the photoreceptor drum and the end of the cleaning blade abut on each other, an urging force applied by the urging force applier for the cleaning blade causes the end of the cleaning blade and the photoreceptor drum to abut on each other, in a state where the part of the cleaning blade supporter and the cleaning blade movement restrictor abut on each other.

4. An image forming apparatus that forms a developer image on a photoreceptor drum, transfers the developer image to a recording medium, and outputs the recording medium, the image forming apparatus comprising:

the cleaning device according to claim 1.

5. A cleaning device, comprising:

a cleaning blade that abuts against a photoreceptor drum and removes residual developer;

a cleaning blade supporter that rotatably supports the cleaning blade;

a cleaning blade movement restrictor that restricts a movement range of the cleaning blade; and an urging force applier for the cleaning blade that urges an end of the cleaning blade to abut against the photoreceptor drum, wherein an abutment state between the photoreceptor drum and the end of the cleaning blade includes a second abutment state in which when the photoreceptor drum and the end of the cleaning blade abut on each other, an urging force applied by the urging force applier for the cleaning blade causes the end of the cleaning blade and the photoreceptor drum to abut on each other, in a state where the part of the cleaning blade supporter and the cleaning blade movement restrictor abut on each other.

6. The cleaning device according to claim 5, wherein the cleaning blade movement restrictor includes a cleaning blade position adjuster that adjusts a position where the movement range of the cleaning blade is restricted by abutment of a part of the cleaning blade supporter against the cleaning blade position adjuster.

7. The cleaning device according to claim 5, wherein an abutment state between the photoreceptor drum and the end of the cleaning blade includes a first abutment state in which when the photoreceptor drum and the end of the cleaning blade abut on each other, an urging force applied by the urging force applier for the cleaning blade causes the end of the cleaning blade and the photoreceptor drum to abut on each other, in a state where the part of the cleaning blade supporter and the cleaning blade movement restrictor do not abut on each other.

8. An image forming apparatus that forms a developer image on a photoreceptor drum, transfers the developer image to a recording medium, and outputs the recording medium, the image forming apparatus comprising:

the cleaning device according to claim 5.

* * * * *